US011459775B2

(12) United States Patent
Cipriani

(10) Patent No.: US 11,459,775 B2
(45) Date of Patent: Oct. 4, 2022

(54) SUPPORT SYSTEM FOR RAISED FLOORS

(71) Applicant: DAKOTA GROUP S.A.S. DI ZENO CIPRIANI & C., Affi (IT)

(72) Inventor: Zeno Cipriani, Affi (IT)

(73) Assignee: DAKOTA GROUP S.A.S. DI ZENO CIPRIANI & C., Affi (IT)

( * ) Notice: Subject to any disclaimer, the term of this patent is extended or adjusted under 35 U.S.C. 154(b) by 2 days.

(21) Appl. No.: 17/278,928

(22) PCT Filed: Sep. 24, 2019

(86) PCT No.: PCT/IB2019/058080
§ 371 (c)(1),
(2) Date: Mar. 23, 2021

(87) PCT Pub. No.: WO2020/065519
PCT Pub. Date: Apr. 2, 2020

(65) Prior Publication Data

US 2022/0049506 A1 Feb. 17, 2022

(30) Foreign Application Priority Data

Sep. 24, 2018 (IT) ..... 102018000008855

(51) Int. Cl.
*E04F 15/024* (2006.01)

(52) U.S. Cl.
CPC .. *E04F 15/02452* (2013.01); *E04F 15/02458* (2013.01)

(58) Field of Classification Search
CPC ..... E04F 15/02452; E04F 15/02458
See application file for complete search history.

(56) References Cited

U.S. PATENT DOCUMENTS

| | | | | |
|---|---|---|---|---|
| 3,150,748 | A | 9/1964 | Liskey, Jr. | |
| 3,681,882 | A | 8/1972 | Bettinger | |
| 4,630,417 | A * | 12/1986 | Collier | E04F 15/02452 174/487 |
| RE33,220 | E | 5/1990 | Collier | |
| 9,976,312 | B2 * | 5/2018 | Boschian | E04F 15/02044 |
| 2006/0242916 | A1 * | 11/2006 | Simko | E04F 19/061 52/177 |
| 2017/0044776 | A1 * | 2/2017 | Rodriguez Lopez | E04F 15/02405 |
| 2017/0138063 | A1 * | 5/2017 | Boschian | E04B 1/003 |

FOREIGN PATENT DOCUMENTS

WO 2015/159136 10/2015

OTHER PUBLICATIONS

EPO communication about intention to grant a patent for corresponding European Application No. 19786668.4 (21 pages). (Year: 2022).*

International Search Report for PCT/IB2019/058080, dated Dec. 16, 2019, 3 pages.

Written Opinion of the ISA for PCT/IB/2019/058080, dated Dec. 16, 2019, 5 pages.

* cited by examiner

*Primary Examiner* — Rodney Mintz
(74) *Attorney, Agent, or Firm* — Nixon & Vanderhye

(57) ABSTRACT

Disclosed is a section bar and a support system for raised floors including the section bar. In particular, the section bar is particularly shaped and the presence of this section bar makes the support system fast and simple to assemble.

20 Claims, 5 Drawing Sheets

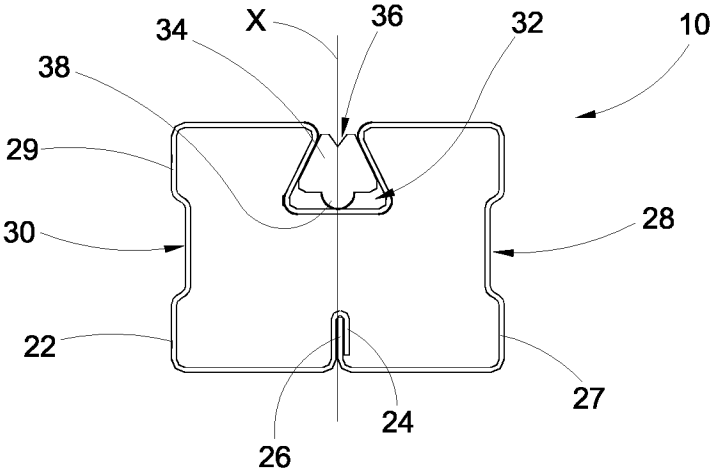
Fig. 4
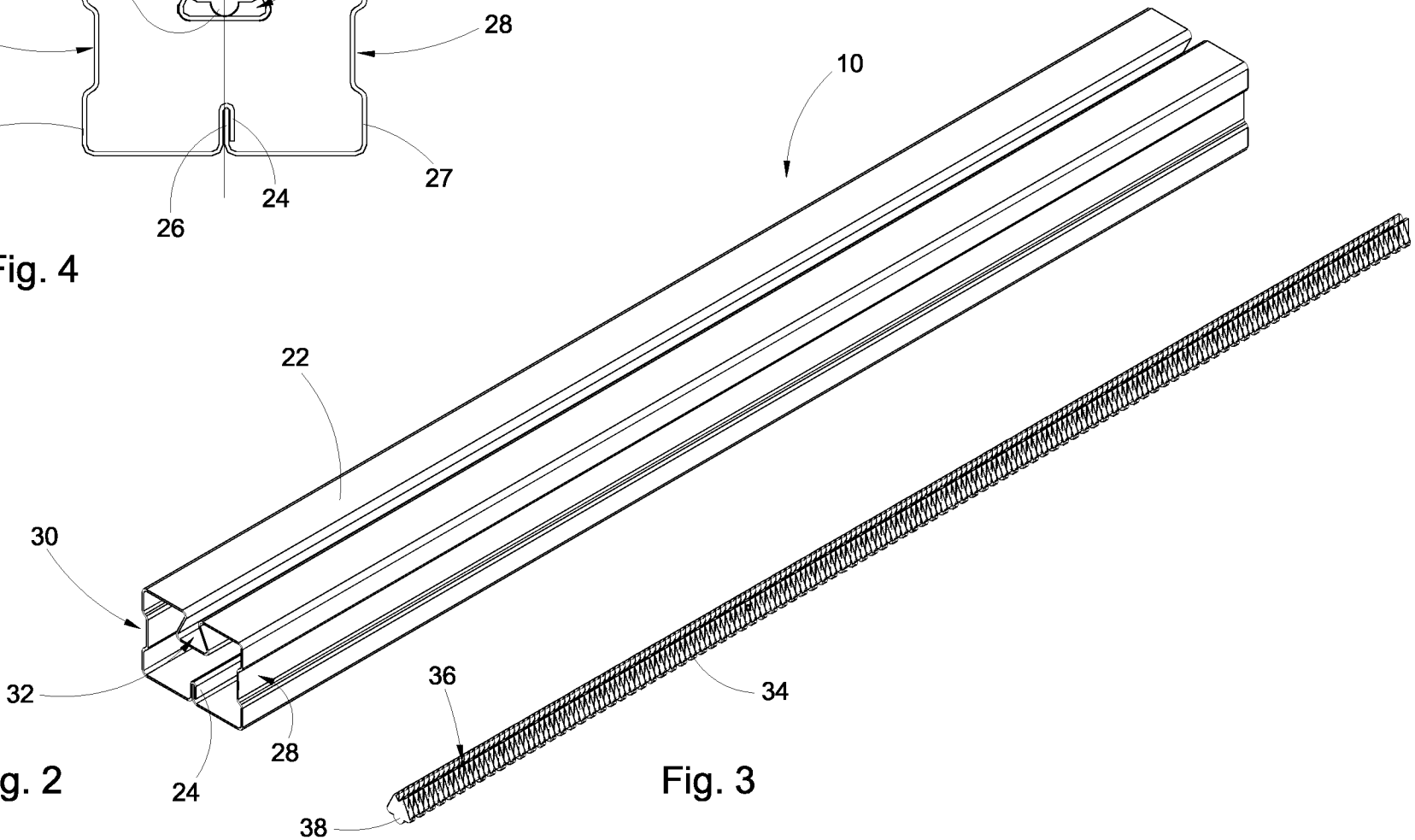
Fig. 2
Fig. 3

SUPPORT SYSTEM FOR RAISED FLOORS

This application is the U.S. national phase of International Application No. PCT/IB2019/058080 filed 24 Sep. 2019, which designated the U.S. and claims priority to IT Patent Application No. 102018000008855 filed 24 Sep. 2018, the entire contents of each of which are hereby incorporated by reference.

The present invention refers in general to a support system for floors including a section bar. In particular, the present invention refers to a system that is fast and simple to assemble and designed to support floors and including a particularly shaped section bar.

The raised floors are systems of raised flooring in which the walkable area rests on a structure that is elevated from the ground and is usually built using suspended modular elements. In this way, it is possible to obtain an inspectable technical compartment between the ground and the walkable plane. For example, this compartment can be useful for the passage of cables.

As it is known, there exist various types of raised floorings including the floors that allow the realization of a stable wooden surface, for example using wooden boards or planks.

The realization procedure for making said raised wooden floorings provides first the realization of a raised support base and then the fixing of the wooden planks. The wooden planks are fixed by blocking one plank at a time to the support base and adjacent to the last fixed wooden plank.

Thus, the realization and installation procedure is rather laborious and therefore slow.

Besides, if there is a need to lift or replace a specific plank, it is usually necessary to remove a large number of planks adjacent to the plank to be lifted or replaced.

In an attempt to remedy these problems, longitudinal elements have been used, for example section bars that are arranged on support feet and act as an interconnection between the planks forming the upper flooring and the same support feet.

Usually, the connection between said section bars and the planks, as well as between the section bars and the support feet is rather complex and laborious.

SUMMARY OF THE INVENTION

An object of the invention is therefore to realize a support system including a suitable section bar, adapted to support raised floors consisting of wooden planks or similar material, in order to overcome the problems of the prior art.

Another object of the invention is to provide a support system for raised floorings making the assembly operations comfortable and fast.

A further object of the invention is to provide a support system for raised floorings that, in case of breakages of the flooring itself, allows repairs to be carried out easily and quickly enough.

All the aforesaid objects and others are achieved according to the invention through a support system for realizing a flooring with planks A of wood or similar material, said flooring being raised with respect to a reference ground.

The support system according to the invention comprises a support foot that rests on the reference ground, a connector to be coupled with at least one plank A, and a section bar having an elongated shape and including a sheet shaped in such a way that the cross-section of the same section bar is substantially H-shaped, a seat of triangular section and open to the top being formed superiorly and being suitable for the positioning of a core.

The so-shaped section bar allows to obtain an important load resistance and allows to accommodate the core which allows the connection with other elements.

This support system can be assembled very quickly and can be modulated according to the extension of the floor in that the section bar can be cut according to the desired size.

The support system according to the invention is characterized by the fact that the section bar comprises a core received inside the section bar itself.

Moreover, the connector is fixable to the section bar by means of a screw to be screwed through the connector into the core so as to expand the core and fix the core itself to the section bar.

This configuration allows that once the screw has been screwed into the core, the core widens and becomes firmly attached to the section bar, which makes the support system safe and stable.

Advantageously, the support system according to the invention may comprise a receiving element adapted to connect the support foot with the section bar so as to make the same section bar easily coupled to the support foot and easily decoupled from the support foot.

Advantageously, the receiving element may comprise a platelet from which at least one small tooth protrudes inferiorly and at least one clip tooth protrudes superiorly, so that the receiving element may be fixed to the support foot by means of the at least one small tooth and that the receiving element may engage the section bar by means of the at least one clip tooth.

Furthermore, the receiving element may comprise two small walls, one opposite to the other, separated by a distance equal to the width of the section bar, so that in the coupling phase, the section bar may be easily received between the two small walls and make assembly easy.

Advantageously, the support foot may include a connection disk to be coupled with the receiving element so as to simplify the coupling.

Advantageously, lateral faces may be comprised in which a right recess and a left recess are formed, respectively.

Other elements may be inserted in the aforesaid recesses so as to allow a coupling with other elements of the support system. Besides, the recesses confer greater load resistance.

Moreover, a sheet metal may be comprised and is bent so as to obtain an essentially H-shaped cross section for the section bar.

Through this aspect, it is possible to realize the section bar starting from a flat sheet metal.

Advantageously, the sheet metal may include ends which are wound together and fixed in correspondence of the central axis X of the cross-section of the section bar so as to realize a section bar that is hardly decomposable.

BRIEF DESCRIPTION OF THE DRAWINGS

Further features and details of the invention will be better understood from the following description, supplied by way of a non-limiting embodiment, as well as from the annexed drawing, wherein:

FIG. 2 is an axonometric view of the section bar in FIG. 1;

FIG. 3 is an axonometric view of a completion element of the section bar in FIG. 1;

FIG. 4 is a front view of the section bar in FIG. 1 with the completion element in FIG. 3;

DESCRIPTION OF THE PREFERRED EMBODIMENTS

Figure 1:
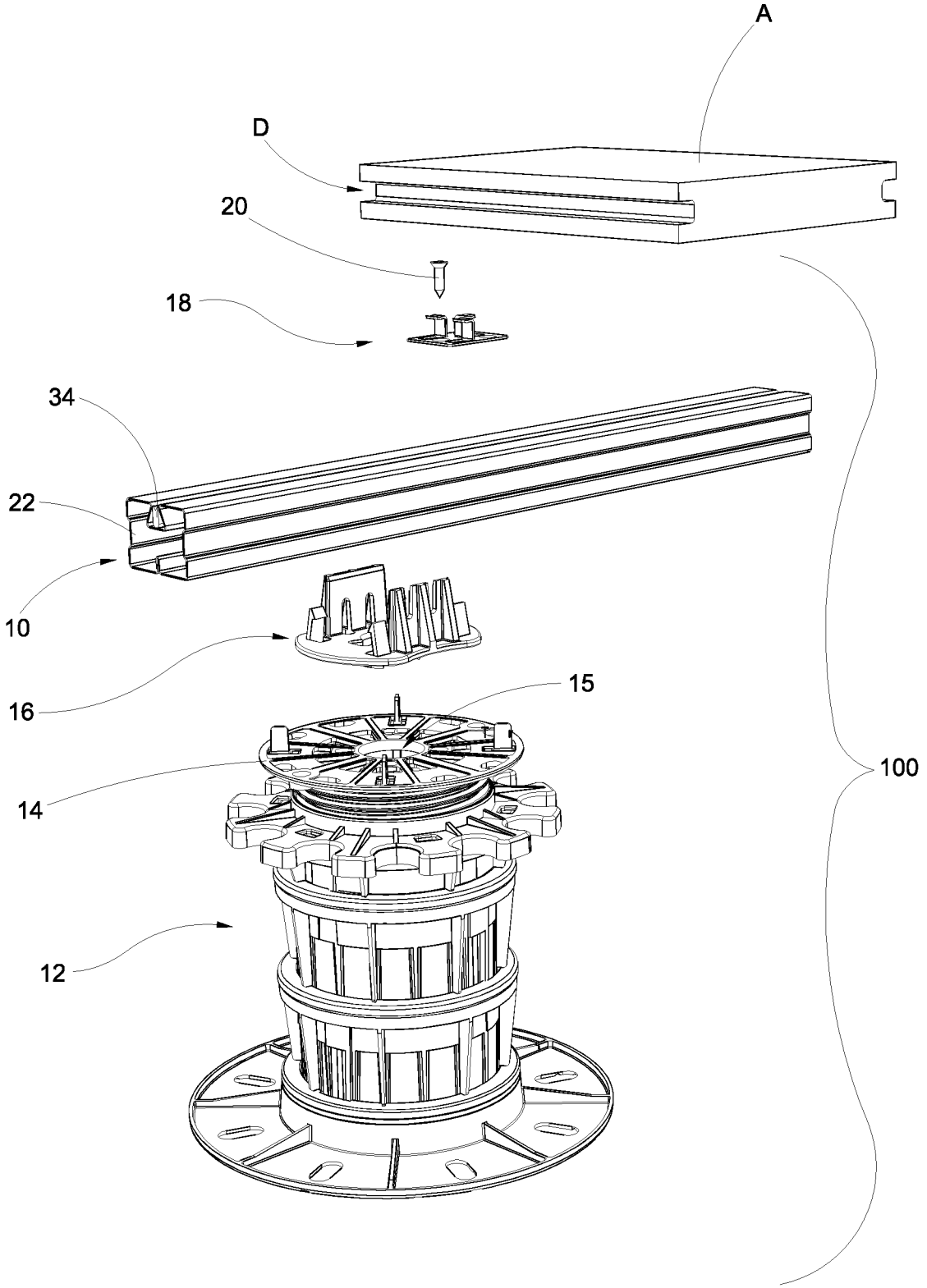
FIG. 1 is an axonometric exploded view of a support system including a section bar, according to the invention.
Figure 7:
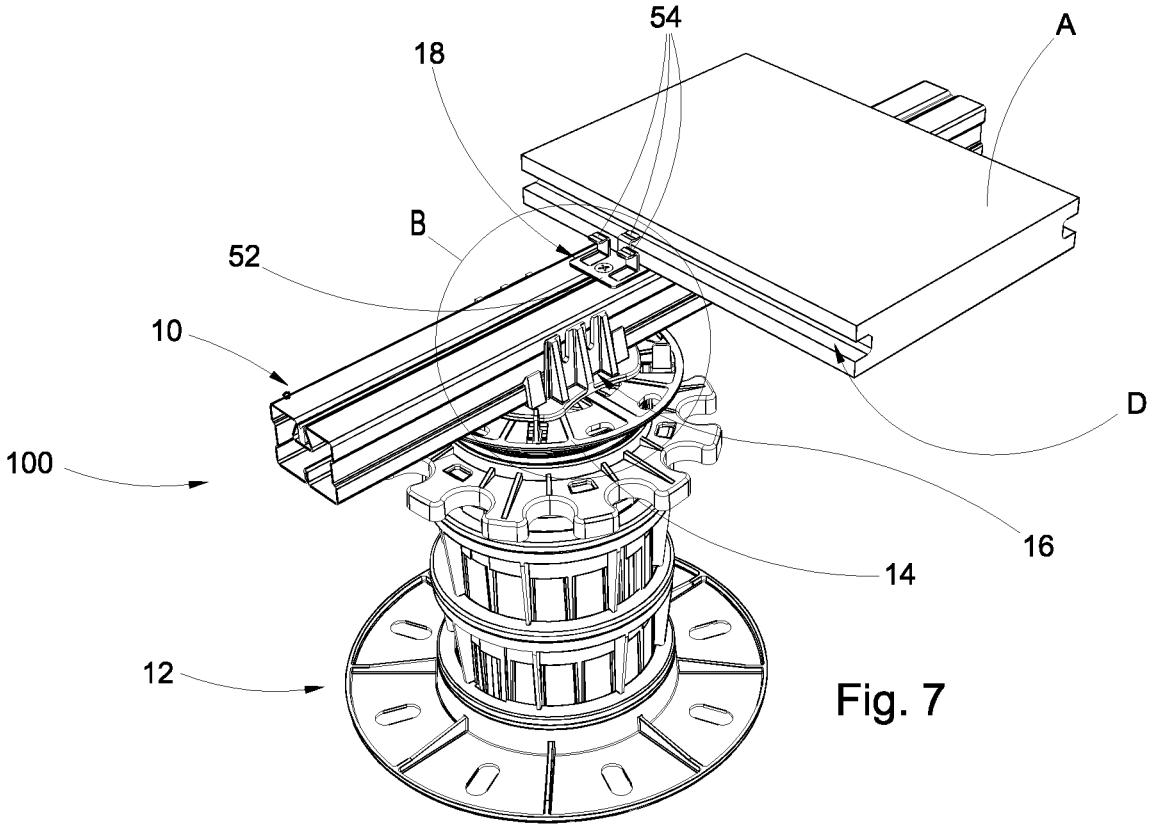
FIG. 7 is an axonometric view of the support system in FIG. 1.
Figure 9:
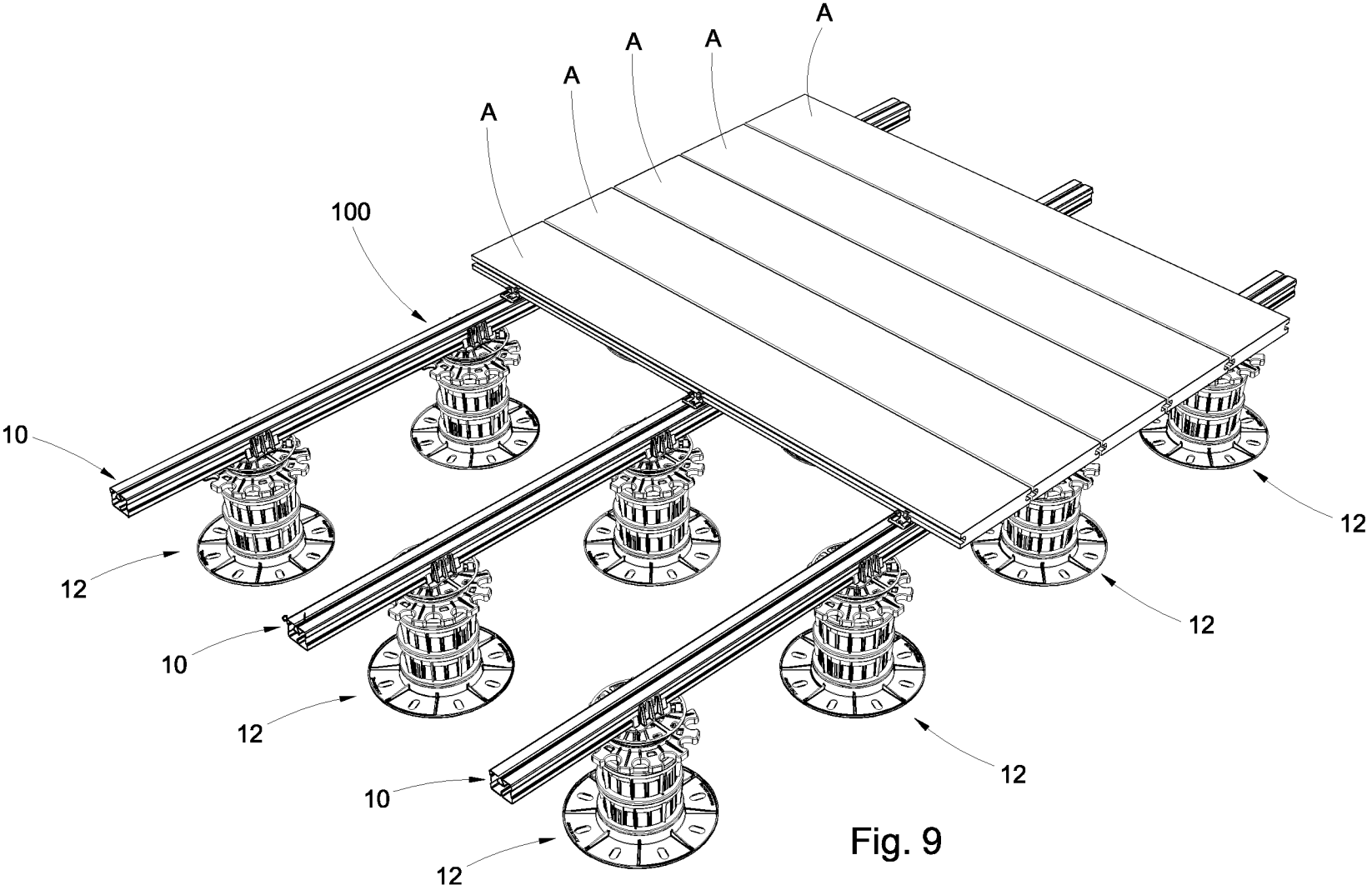
FIG. 9 is an axonometric view of a flooring under construction by using the support system in FIG. 1.

With reference to the annexed drawing, in particular FIGS. 1, 7 and 9, reference number 100 denotes a support system according to the invention for the realization of raised floorings by using planks A of wood or similar material.

The support system 100 includes:

- a support foot 12 adapted to be placed on a reference ground and already subject of protection held by the holder of the present right;
- a connection disk 14 which is adapted to be fixed to the support foot 12 and in which openings 15 are formed;
- a receiving element 16 to be bound to the connection disk 14;
- a section bar 10 adapted to be received in the receiving element 16 in a stable manner;
- a connector 18 to be fixed to the section bar 10 by means of a screw 20 and adapted to be coupled with one or more planks A.

As it appears from FIGS. 2 and 4, the section bar 10 has an elongated shape and consists of a sheet metal 22 which is shaped in such a way that the cross section of the same section bar 10 has a substantially H-shaped form.

The substantially H-shaped form gives the section bar 10 an important resistance to load.

In particular, the ends 24, 26 of the sheet metal 22 are wound and fixed to each other in correspondence of the central axis X of the cross section of the section bar 10.

The lateral faces 27, 29 of the cross section of the section bar 10 include a right recess 28 and a left recess 30.

A triangular seat 32 (having triangular section) is formed on the upper part, also in the cross section, in correspondence of the central axis X, and is open upwards. A core 34, also of triangular shape, is received in the triangular seat.

The core 34 is made of plastic material or rubber, a V-shaped cavity 36 being formed on the upper part of the core. Besides, the core 34 includes a lower protrusion.

Figure 6:
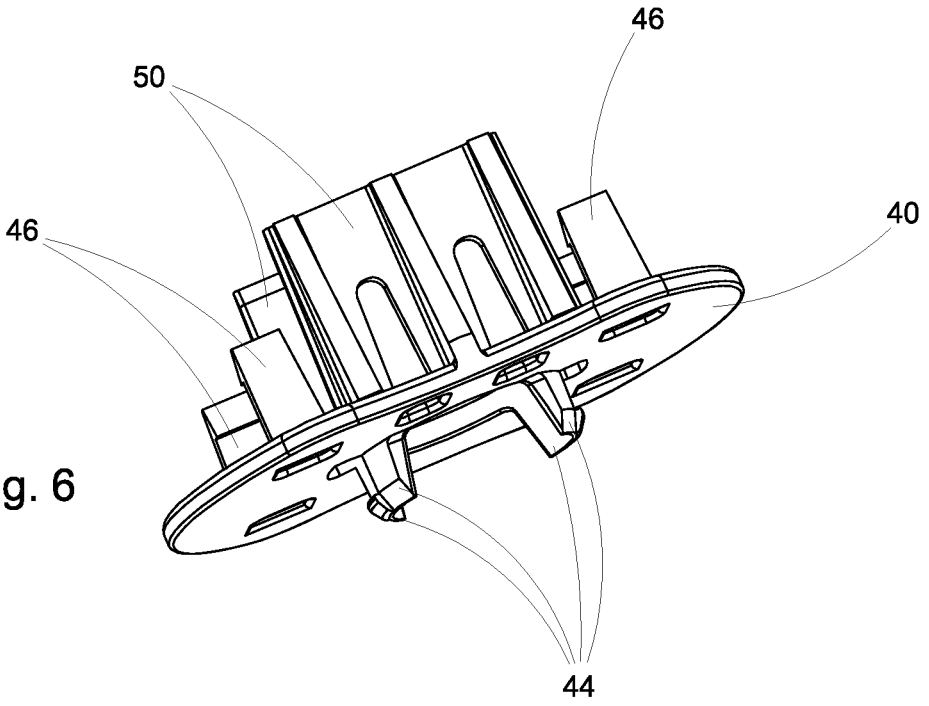
FIGS. 5 and 6 are axonometric views of a connection element of the support system in FIG. 1.
Figure 5:
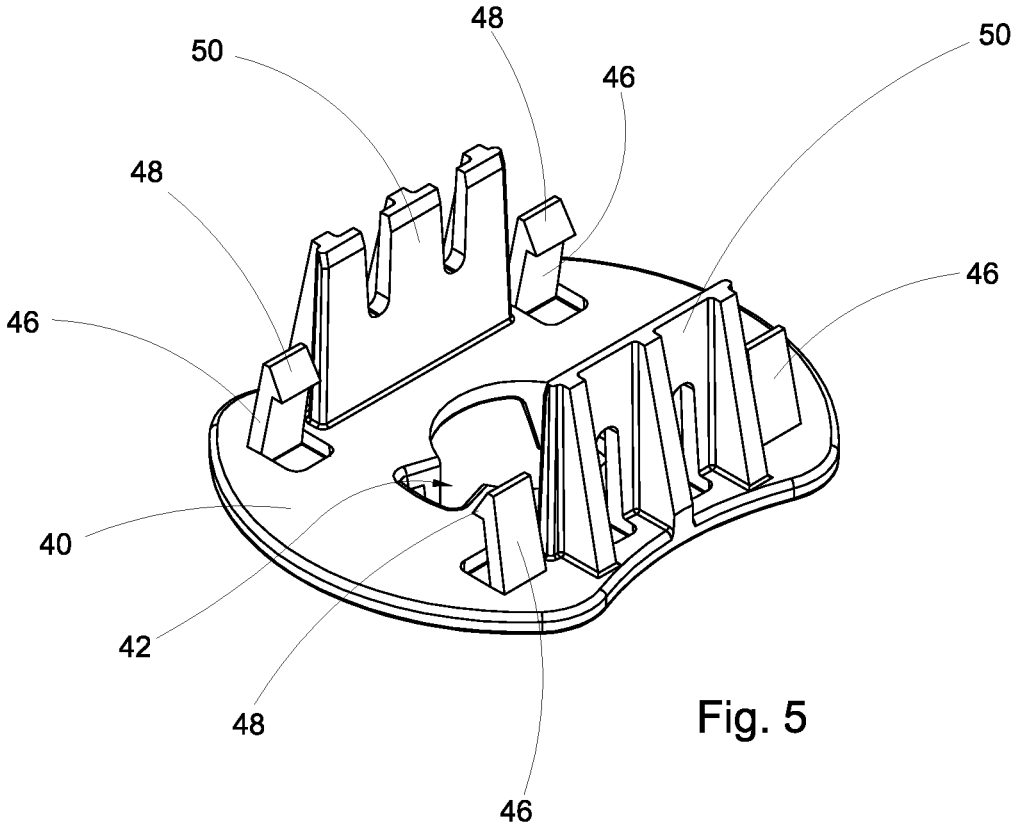

As shown in FIGS. 5 and 6, the receiving element 16 includes an elliptical platelet 40 in which a through hole 42 is formed.

Four small teeth 44 protrude from the lower side of the platelet 40.

Clip teeth 46 protrude from the upper side of the aforesaid platelet, each clip tooth being provided with a protrusion 48. The clip teeth 46 are arranged in pairs, two on one side and two on the other side, with respect to the through hole 42.

In addition, two small walls 50, opposite to each other, protrude from the upper side of the platelet 40, are divided by the through hole 42 and are placed between two clip teeth 46.

The connector 18 includes a flat element 52 from which three hooks 54 protrude and are facing different sides so as to fit into the seats D formed in the planks A.

Figure 8:
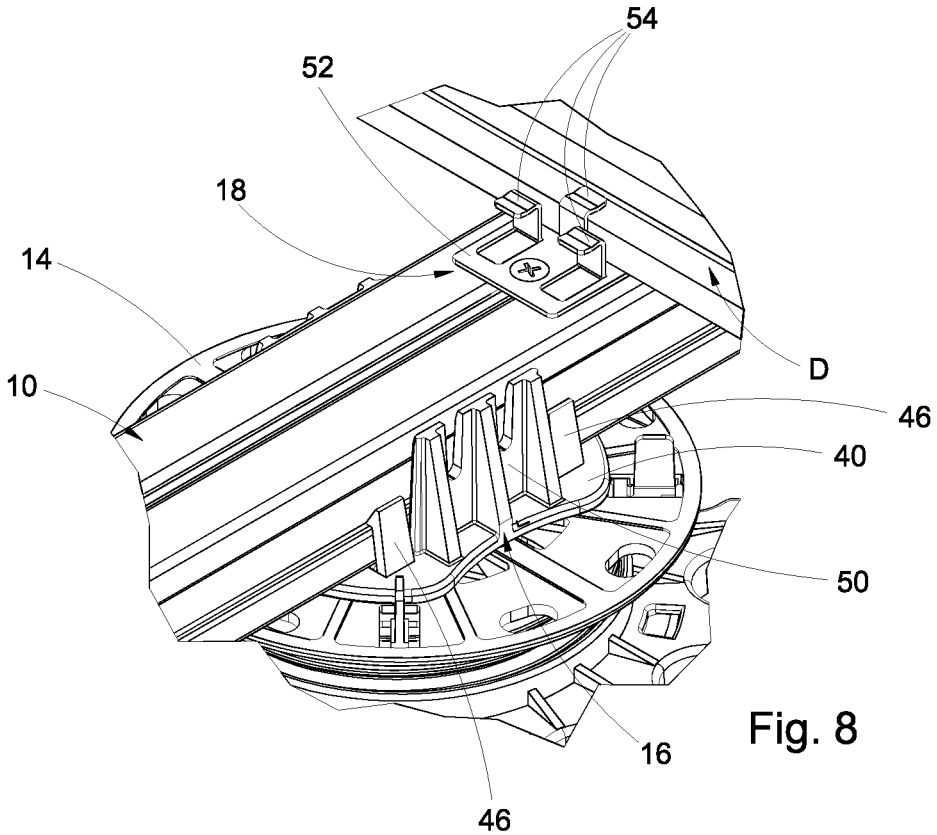
FIG. 8 is an axonometric view of a detail denoted by B in FIG. 7.

As shown in FIGS. 7, 8, 9, the procedure of realization of a raised floor by means of several planks A, placed side by side, provides first the arrangement of more support feet 12 resting on the reference ground.

As it appears from FIG. 9, the support feet 12 are arranged in several rows owing to the elongated shape of the section bars 10 to be coupled to the same support feet 12.

A connection disk 14 is screwed to the top of each support foot 12.

The four small teeth 44 protruding from the platelet 40 of the receiving element 16 are inserted in the openings 15 of the connection disk 14 so as to constrain the receiving element 16 to the respective support feet 12.

A section bar 10 is coupled to the receiving element 16; in particular, this coupling is guaranteed by the clip teeth 46 whose protrusions 48 are inserted in the lateral offsets formed by the right recess 28 and the left recess 30.

The coupling of each section bar 10 with the respective receiving element 16 is obtained first by inserting the section bar between the two small walls 50 and then, by pushing the same section bar towards the bottom of the receiving element 16 so as to open wide the clip teeth 46 as long as the protrusions 48 of the same clip teeth 46 are inserted in the right recess 28 and left recess 30.

In this way, the section bar 10 is coupled to the receiving element 16 and can only translate according to a longitudinal direction with respect to the same receiving element 16.

The connector 18 is fixed to the section bar 10 which when it is coupled to the receiving element 16, already includes the core 34. In particular, a screw 20 is passed through a hole formed in the connector 18 and is screwed into the core 34.

The V-shape of the cavity 36 facilitates the positioning of the screw 20 in the correct place. By screwing the screw 20, the core 34 expands so that the stripping strength of the screw 20 itself increases.

The support system 100 is thus completed and a plank A can be fixed on it by inserting the hooks 54 in the seats D formed in the planks A.

Of course, the shape and configuration of the connector 18 may be different, also depending on the coupling mode to couple the same connector 18 to the planks A.

Other variants and different implementation methods are possible which are to be considered as included in the scope of protection as defined by the claims.

For example, the conformation of the section bar can be different from the one described above, namely the section of the section bar can be higher or lower, but must ensure the positioning of a core inside and coupling means, similar to the receiving element 16, for the fixing of the section bar to the support feet.

The invention claimed is:

1. A support system (100) for realizing a flooring with wooden planks (A), said flooring being raised with respect to a reference ground, said support system comprising:

- a support foot (12) configured to rest on the reference ground;
- a connector (18) configured to be coupled with at least one said plank LAI;
- a section bar (10) configured to connect the support foot (12) with the connector (18) and consequently with the at least one plank (A); the section bar (10) having a width and an elongated shape and includes a sheet (22) shaped in such a way that a cross-section of the section bar (10) is substantially H-shaped, and a seat (32) of triangular section having an open top being formed superiorly;

wherein the system comprises a core (34) received inside the section bar (10); the connector (18) configured to be fixed to the section bar (10) by means of a screw (20) inserted through the connector (18) into the core (34) so as to expand the core (34) and fix the core (34) to the section bar (10).

2. The support system (100) according to claim 1, wherein lateral faces (27, 29) are comprised in the section bar, lateral faces (27, 29) in which a right recess (28) and a left recess (30) are formed, respectively.

3. The support system (100) according to claim 1, wherein the sheet (22) is bent so as to obtain the substantially H-shaped cross section for the section bar (10).

4. The support system (100) according to claim 3, wherein the sheet (22) includes ends (24, 26) which are wound together and fixed in correspondence of central axis (X) of the cross-section of the section bar (10).

5. The support system (100) according to claim 1, wherein a receiving element (16) is comprised and connects the support foot (12) to the section bar (10).

6. The support system (100) according to claim 5, wherein lateral faces (27, 29) are comprised in the section bar, lateral faces (27, 29) in which a right recess (28) and a left recess (30) are formed, respectively.

7. The support system (100) according to claim 5, wherein lateral faces (27, 29) are comprised in the section bar, lateral faces (27, 29) in which a right recess (28) and a left recess (30) are formed, respectively.

8. The support system (100) according to claim 5, wherein the sheet (22) is bent so as to obtain the substantially H-shaped cross section for the section bar (10).

9. The support system (100) according to claim 5, wherein the receiving element (16) comprises a platelet (40) from which at least one small tooth (44) protrudes inferiorly and at least one clip tooth (46) protrudes superiorly, so that the receiving element (16) is fixed to the support foot (12) by means of the at least one small tooth (44) and that the receiving element (16) engages the section bar (10) by means of the at least one clip tooth (46).

10. The support system (100) according to claim 9, wherein the support foot (12) includes a connection disk (14) to be coupled with the receiving element (16).

11. The support system (100) according to claim 9, wherein lateral faces (27, 29) are comprised in the section bar, lateral faces (27, 29) in which a right recess (28) and a left recess (30) are formed, respectively.

12. The support system (100) according to claim 9, wherein the sheet (22) is bent so as to obtain the substantially H-shaped cross section for the section bar (10).

13. The support system (100) according to claim 9, wherein the receiving element (16) comprises two small walls (50), one opposite to the other, separated by a distance equal to the width of the section bar (10), so that in coupling phase, the section bar (10) is received between the two small walls (50).

14. The support system (100) according to claim 13, wherein the support foot (12) includes a connection disk (14) to be coupled with the receiving element (16).

15. The support system (100) according to claim 5, wherein the receiving element (16) comprises two small walls (50), one opposite to the other, separated by a distance equal to the width of the section bar (10), so that in coupling phase, the section bar (10) is received between the two small walls (50).

16. The support system (100) according to claim 15, wherein the support foot (12) includes a connection disk (14) to be coupled with the receiving element (16).

17. The support system (100) according to claim 15, wherein the sheet (22) is bent so as to obtain the substantially H-shaped cross section for the section bar (10).

18. The support system (100) according to claim 5, wherein the support foot (12) includes a connection disk (14) to be coupled with the receiving element (16).

19. The support system (100) according to claim 18, wherein lateral faces (27, 29) are comprised in the section bar, lateral faces (27, 29) in which a right recess (28) and a left recess (30) are formed, respectively.

20. The support system (100) according to claim 18, wherein the sheet (22) is bent so as to obtain the substantially H-shaped cross section for the section bar (10).

* * * * *